US007576596B2

(12) United States Patent
Lee et al.

(10) Patent No.: US 7,576,596 B2
(45) Date of Patent: Aug. 18, 2009

(54) INTERNAL VOLTAGE GENERATOR OF SEMICONDUCTOR DEVICE

(75) Inventors: Kang-Seol Lee, Kyoungki-do (KR); Ji-Eun Jang, Kyoungki-do (KR)

(73) Assignee: Hynix Semiconductor, Inc., Gyeonggi-do (KR)

( * ) Notice: Subject to any disclaimer, the term of this patent is extended or adjusted under 35 U.S.C. 154(b) by 119 days.

(21) Appl. No.: 11/714,194

(22) Filed: Mar. 6, 2007

(65) Prior Publication Data

US 2008/0001653 A1 Jan. 3, 2008

(30) Foreign Application Priority Data

Jun. 30, 2006 (KR) ..... 10-2006-0061409

(51) Int. Cl.
*G05F 1/10* (2006.01)

(52) U.S. Cl. ..... 327/538; 327/540; 327/543

(58) Field of Classification Search ..... 327/538, 327/540, 541, 543; 323/315, 316
See application file for complete search history.

(56) References Cited

U.S. PATENT DOCUMENTS

| | | | | |
|---|---|---|---|---|
| 5,319,302 | A * | 6/1994 | Koshikawa et al. | 323/273 |
| 6,194,887 | B1 * | 2/2001 | Tsukada | 323/315 |
| 6,300,749 | B1 * | 10/2001 | Castelli et al. | 323/273 |
| 6,563,746 | B2 | 5/2003 | Fujioka et al. | |
| 6,791,308 | B2 * | 9/2004 | Shim | 323/314 |
| 6,867,641 | B2 | 3/2005 | Kang et al. | |
| 6,947,347 | B2 | 9/2005 | Fujioka | |
| 2004/0001385 | A1 | 1/2004 | Kang | |
| 2006/0091937 | A1 | 5/2006 | Do | |

FOREIGN PATENT DOCUMENTS

| | | |
|---|---|---|
| JP | 10-125097 | 5/1998 |
| JP | 2003-85977 A | 3/2003 |
| KR | 1996-0019291 | 6/1996 |
| KR | 10-0152905 B1 | 6/1998 |
| KR | 2000-0003599 | 1/2000 |
| KR | 2002-0091958 | 12/2002 |

OTHER PUBLICATIONS

Korean Office Action issued in Korean Patent Application No. 10-2006-0061409, dated on Nov. 11, 2008.

* cited by examiner

*Primary Examiner*—Kenneth B. Wells
(74) *Attorney, Agent, or Firm*—Mannava & Kang P.C.

(57) ABSTRACT

Embodiments of the present invention are directed to provide an internal voltage generator of a semiconductor memory device for generating a predetermined stable level of an internal voltage. The semiconductor memory device includes a control signal generator, an internal voltage generator and an internal voltage compensator. The control signal generator generates a reference signal and a compensating signal which are corresponding to voltage level of the reference signal. The internal voltage generator generates an internal voltage in response to the reference signal. The internal voltage compensator compensates the internal voltage in response to the compensating signal.

31 Claims, 6 Drawing Sheets

INTERNAL VOLTAGE GENERATOR OF SEMICONDUCTOR DEVICE

CROSS-REFERENCE TO RELATED APPLICATIONS

The present invention claims priority of Korean patent application no. 10-2006-0061409, filed in the Korean Patent Office on Jun. 30, 2006, which is incorporated by reference in its entirety.

BACKGROUND OF THE INVENTION

The present invention relates to a semiconductor memory device; more particularly, to an internal voltage generator of the semiconductor device.

The semiconductor memory device is an apparatus for storing a plurality of data and reading the stored data. For efficient data storage and reading, the semiconductor memory device generates a variety of internal voltages for internal operations, using supply and ground voltages provided from an external device. Examples of internal voltages include a core voltage for a data storage area and a driving voltage for a peripheral area. The core voltage is used in the data storage area where a plurality of input data are stored. The driving voltage for the peripheral area is used for outputting data stored in the data storage area to an external device and providing the input data into the data storage area. There are additional internal voltages which are higher than the supply voltage or lower than the ground voltage by predetermined amounts. Those internal voltages are used to efficiently control MOS transistors in the data storage area. An internal voltage higher than the supply voltage is usually provided to gates of MOS transistors in the data storage area. An internal voltage lower than the ground voltage is usually provided as a bulk voltage of MOS transistors in the data storage area. The semiconductor memory device is provided with internal voltage generators to provide the variety of internal voltages.

To perform storage and read operations, the semiconductor memory device receives row and column addresses and other corresponding commands. The semiconductor memory device reads data located in the cell corresponding to the input address or stores input data in the cell corresponding to the address. While accessing data is performed after the row and column addresses are input, the semiconductor memory device is in an active state. While waiting for commands and corresponding addresses for the data access, the semiconductor memory device is in a standby state. In a standby state, circuits awaiting external commands and addresses operate minimally. The semiconductor memory device includes internal voltage generators respectively operating in the active mode and the standby mode to minimize power consumption for generating the internal voltages.

In the beginning, when the supply voltage is provided to the semiconductor memory device, it takes some time for a level of the supply voltage to reach a predetermined level. If the semiconductor memory device starts operating with a supply voltage which is lower than the predetermined level, malfunctions can be caused. Accordingly, the semiconductor memory device requires a circuit for sensing a level of ascent of the supply voltage until the supply voltage becomes higher than the predetermined level. Such a circuit is generally called a power up circuit. A sensing signal generated by the power up circuit is called a power up signal. An internal voltage generator in the semiconductor memory device generates the internal voltage for the internal operation in response to the power up signal.

With respect to a normal operation of the semiconductor memory device, it is important that the level of an internal voltage is maintained stably. As described above, an internal voltage generator in the semiconductor memory device generates an internal voltage for the internal operation in response to the power up signal. An internal voltage generator doesn't sense and maintain the level of its respective internal voltage after generating the internal voltage. Unless the level of the internal voltage is maintained to a predetermined level, malfunctions can be caused. Particularly, if the level of the internal voltage generated right after the power up signal is generated is changed, the semiconductor memory device may make an error in an initial operation.

SUMMARY OF THE INVENTION

Embodiments of the present invention are directed to providing an internal voltage generator of a semiconductor memory device for generating a predetermined stable level of internal voltage.

In accordance with an aspect of the present invention, the semiconductor memory device comprises a control signal generator for generating a reference signal and a compensating signal which corresponding to the voltage level of the reference signal, an internal voltage generator for generating an internal voltage in response to the reference signal and an internal voltage compensator for compensating the internal voltage in response to the compensating signal.

In accordance with another aspect of the present invention, a method for driving the semiconductor memory device comprises generating a first reference signal as a first voltage level and a second reference signal as a second voltage level which is lower than the first voltage level, generating an internal voltage in response to the first reference signal and compensating the internal voltage in response to the second reference signal.

In accordance with a further aspect of the present invention, a method for driving the semiconductor memory device comprises generating a first reference signal as a standard of generating an internal voltage, generating the internal voltage in response to the first reference signal, generating a supply voltage sensing signal when the level of a supply voltage is lower than a predetermined level and compensating the internal voltage is response to the supply voltage sensing signal.

In accordance with a further aspect of the present invention, the semiconductor memory device comprises a control signal generator for generating a reference signal and a compensating signal corresponding to the reference signal, an internal voltage generator for generating an internal voltage in response to the reference signal, an internal voltage sensor for sensing the internal voltage and generating an internal voltage sensing signal, a voltage comparator for comparing the compensating signal with the internal voltage sensing signal and a voltage compensator for compensating the internal voltage according to a comparing result.

DESCRIPTION OF SPECIFIC EMBODIMENTS

In accordance with the present invention, there is provided an internal voltage generator of a semiconductor memory device for stably generating an internal voltage necessary for internal operations. Even when the supply voltage is lower than a predetermined level, the semiconductor memory device according to the present invention can generate the internal voltage stably. Particularly, when the internal voltage is decreased, the internal voltage having a required level is stably maintained by compensating the deceased internal voltage conveniently. Accordingly reliability of the semiconductor memory device according to the present invention is improved.

Hereinafter, the semiconductor memory device in accordance with the present invention will be described in detail referring to the accompanying drawings.

Figure 1:
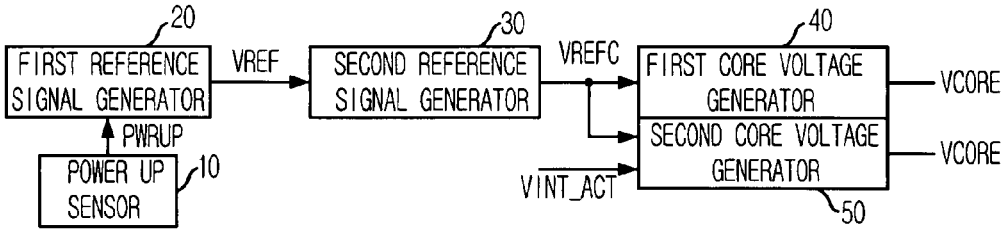
FIG. 1 is a block diagram showing a semiconductor memory device in accordance with the present invention.

FIG. 1 is a block diagram showing a semiconductor memory device in accordance with the present invention. The semiconductor memory device includes a power up sensor 10, a first reference signal generator 20, a second reference signal generator 30, a first core voltage generator 40 and a second core voltage generator 50. The power up sensor 10 senses a supply voltage and generates a power up signal PWRUP enabled according to the level of the supply voltage. The first reference signal generator 20 generates a first reference signal VREF in response to the power up signal PWRUP. The second reference signal generator 30 generates a second reference signal VREFC in response to the first reference signal VREF. The first core voltage generator 40 generates a core voltage VCORE in response to the second reference signal VREFC at a standby mode. The second core voltage generator 50 generates the core voltage VCORE in response to the second reference signal VREFC and an active signal VINT_ACT when in an active mode.

The active mode represents a period when address and command signals are input to the semiconductor memory device and operations corresponding to the input address and command signals are performed. The standby mode means a period when the semiconductor memory device waits for the address and command signals. Because different circuits supplied with the core voltage internally are enabled based on a standby or active mode, the plurality of core voltage generators are provided to generate an appropriate core voltage during each mode.

Figure 2:
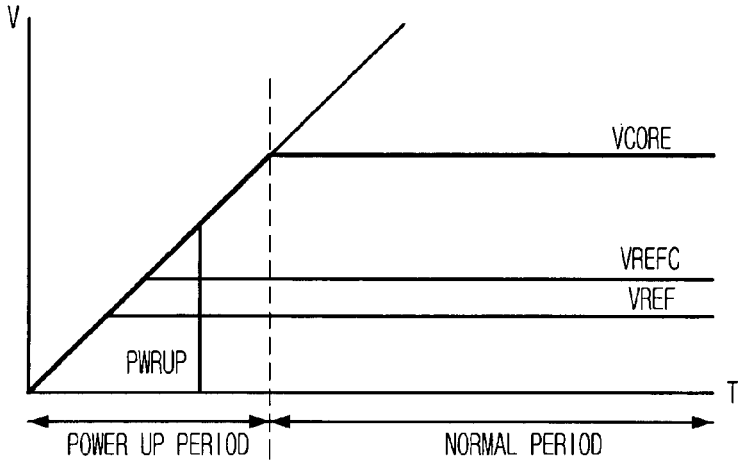
FIG. 2 is a signal timing diagram depicting an operation of the semiconductor memory device described in FIG. 1.

FIG. 2 is a signal timing diagram depicting an operation of the semiconductor memory device described in FIG. 1. A power up period is a period from a point of supplying the supply voltage to the semiconductor memory device to a point when a level of the supply voltage increases to a predetermined level. The power up signal PWRUP increases linearly according to an increase of the supply voltage in the power up period, and when the supply voltage is higher than a predetermined level, the power up signal PWRUP is disabled as a low level. The first reference signal VREF having a first voltage level is output by the first reference signal generator 20 in response to the power up signal PWRUP. The second reference signal VREFC having a second voltage level is output by the second reference signal generator 30 in response to the first reference signal VREF. The first and second core voltage generators 40 and 50 generate a predetermined level of core voltage VCORE in response to the second reference signal VREFC.

Figure 3:
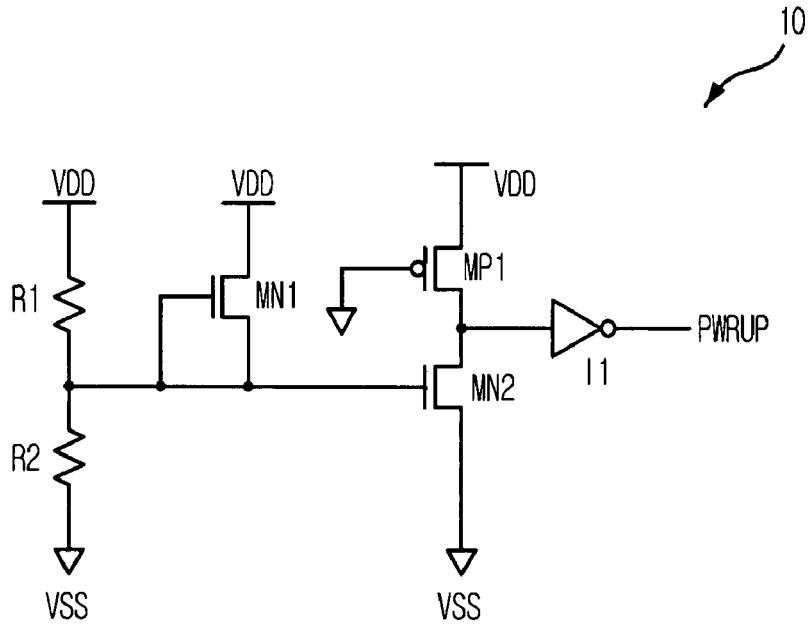
FIG. 3 is a schematic circuit diagram showing a power up sensor described in FIG. 1.

FIG. 3 is a schematic circuit diagram illustrating the power up sensor 10 described in FIG. 1. In the beginning, when the supply voltage VDD is provided to the semiconductor memory device, the supply voltage VDD increases from a level of the ground voltage. The supply voltage VDD is divided by resistors R1 and R2, and provided to a gate of a MOS transistor MN2. Meanwhile, a MOS transistor MP1 continues to be turned on. The supply voltage VDD, decreased in some degree by a turn-on resistance corresponding to the MOS transistor MP1, is input to an inverter I1. Accordingly, the power up signal PWRUP, i.e., an output of the inverter I1, is increased linearly as the supply voltage VDD rises. When the supply voltage VDD generated by the MOS transistor MP1 becomes a predetermined level, the power up signal PWRUP is disabled to a ground voltage level.

Figure 4:
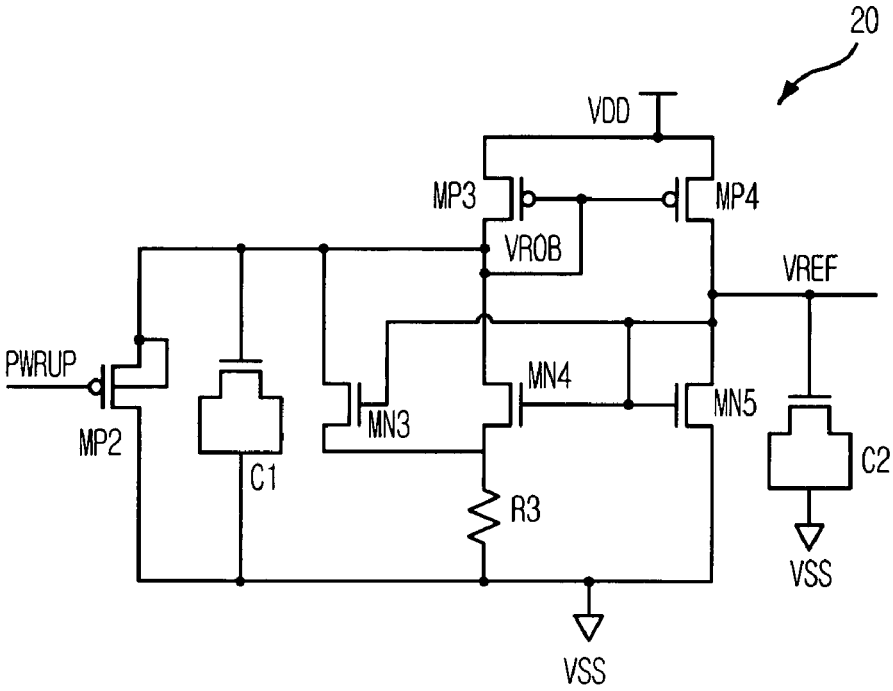
FIG. 4 is a schematic circuit diagram showing a first reference signal generator described in FIG. 1.

FIG. 4 is a schematic circuit diagram illustrating the first reference signal generator 20 described in FIG. 1. The first reference signal generator 20 generates the first reference signal VREF in response to the power up signal PWRUP. Particularly, the first reference signal generator 20 can generate the first reference signal VREF so as to be insensitive to circumstances such as process conditions, fluctuations of the supply voltage, and temperature at operation.

Figure 5:
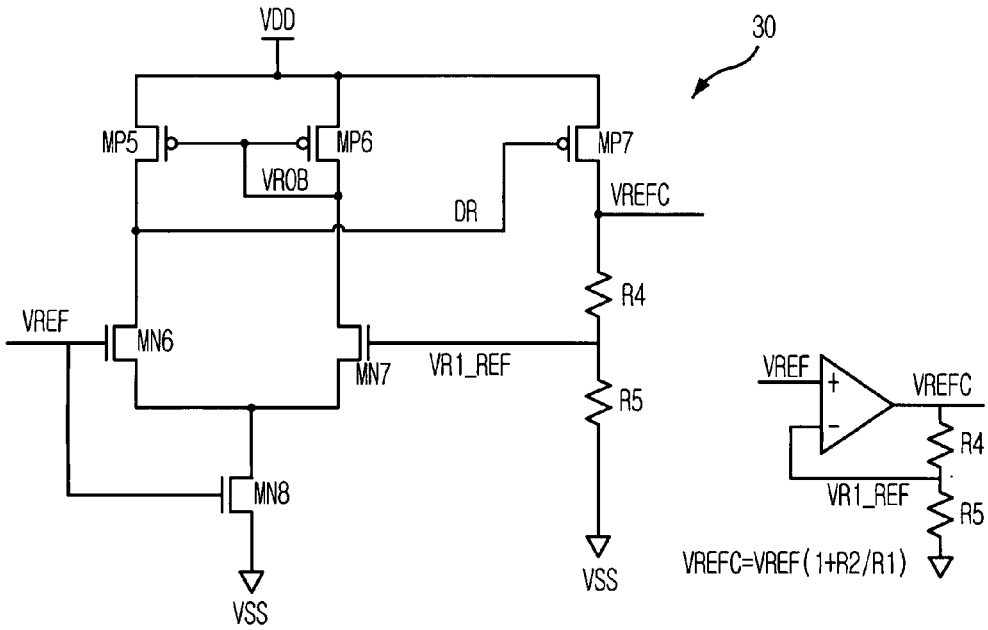
FIG. 5 is a schematic circuit diagram showing a second reference signal generator described in FIG. 1.

FIG. 5 is a schematic circuit diagram illustrating the second reference signal generator 30 described in FIG. 1. The second reference signal generator 30 generates the second reference signal VREFC in response to the first reference signal VREF. Comparing the first reference signal VREF with a first comparing signal VR1_REF, the second reference signal generator 30 increases the second reference signal VREFC when the first reference signal VREF is higher than the first comparing signal VR1_REF. When the first reference signal VREF is lower than the first comparing signal VR1_REF, the second reference signal VREFC is not increased. Accordingly, the level of the second reference signal VREFC is determined by a resistance ratio of the resistors R4 and R5 and the voltage level of the first reference signal VREF. The second reference signal generator 30 is also briefly embodied by an operational amplifier described in FIG. 5.

Figure 6:
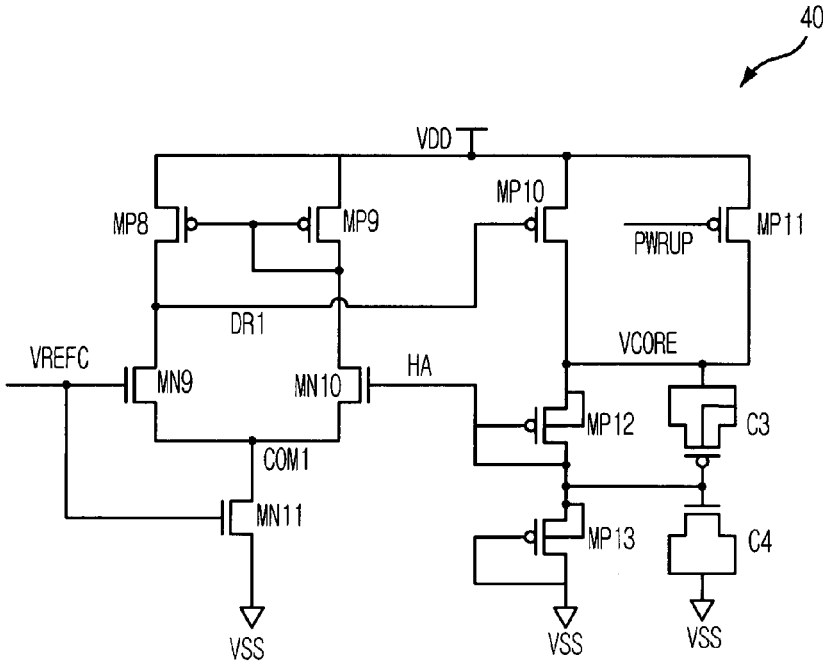
FIG. 6 is a schematic circuit diagram showing a first core voltage generator described in FIG. 1.

FIG. 6 is a schematic circuit diagram showing the first core voltage generator 40 described in FIG. 1. The first core voltage generator 40 outputs the core voltage VCORE in response to the second reference signal VREFC. Comparing a second comparing signal HA with the second reference signal VREFC, the first core voltage generator 40 increases the core voltage VCORE when the second reference signal VREFC is lower than the second comparing signal HA. When the second reference signal VREFC is higher than the second comparing signal HA, the core voltage VCORE is not increased. Capacitors C3 and C4 are there for maintaining the level of the core voltage VCORE. Diode-connected MOS transistors MP12 and MP13 divide the core voltage VCORE to generate the second comparing signal HA.

Figure 7:
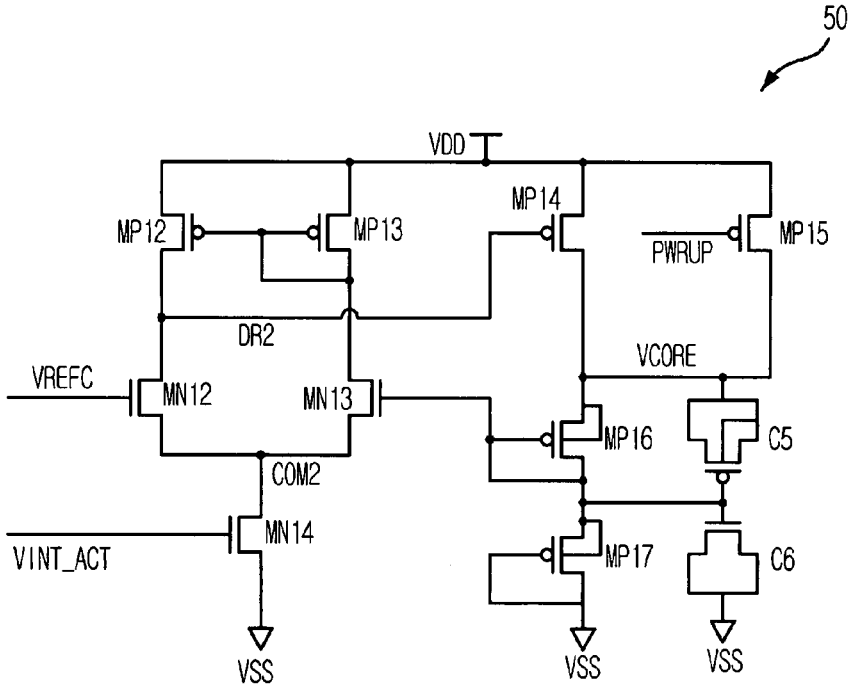
FIG. 7 is a schematic circuit diagram showing a second core voltage generator described in FIG. 6.

FIG. 7 is a schematic circuit diagram illustrating the second core voltage generator 50 described in FIG. 6. Operation of the second core voltage generator 50 is similar to that of the first core voltage senator 40. It differs in that the second core voltage generator 50 performs the operation for comparing voltages in response to the active signal VINT_ACT.

The semiconductor memory device according to an embodiment of the present invention generates the reference signal in response to the power up signal and the internal voltage in response to the reference signal. As technology matures, the semiconductor memory device should operate at higher speeds and reduce power consumption. For reducing the power consumption, it is typical that a lower level supply voltage is supplied to the semiconductor memory device. In the case where the supply voltage is decreased, it could be difficult to stably generate an internal voltage having a required level even by fine fluctuation of the reference signal.

In addition, the semiconductor memory device according to the first embodiment firstly generates the core voltage and merely outputs the core voltage. If the core voltage is decreased, the semiconductor memory device does not have a sufficient ability for compensating the core voltage. However, in another embodiment of the present invention, there is provided a semiconductor memory device with a compensator for compensating the core voltage although the core voltage is decreased.

Figure 8:
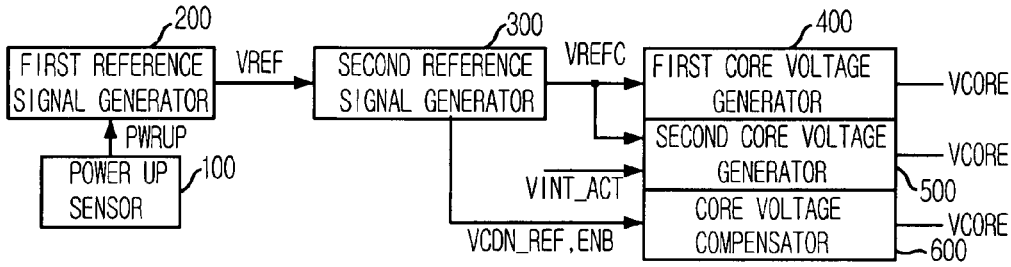
FIG. 8 is a block diagram showing a semiconductor memory device in accordance with another embodiment of the present invention.

FIG. 8 is a block diagram showing the semiconductor memory device in accordance with another embodiment of the present invention. The semiconductor memory device includes a power up sensor 100, a first reference signal generator 200, a second reference signal generator 300, a first core voltage generator 400, a second core voltage generator 500 and core voltage compensator 600. The power up sensor 100 senses a supply voltage to generate a power up signal PWRUP enabled according to the level of the supply voltage. The first reference signal generator 200 generates a first reference signal VREF in response to the power up signal PWRUP. The second reference signal generator 300 generates a second reference signal VREFC having a first voltage level and a compensating signal VCDN_REF having a second voltage level in response to the first reference signal VREF. The second voltage level is lower than the first voltage level by a predetermined level. The first core voltage generator 400 generates a core voltage VCORE in response to the second reference signal VREFC at a standby mode. The second core voltage generator 500 outputs the core voltage VCORE in response to the second reference signal VREFC and an active signal VINT_ACT at an active mode. The core voltage compensator 600 compensates the core voltage VCORE in response to the compensation signal VCDN_REF.

The internal voltage generator of the semiconductor memory device according to the present invention can be applied to generate a variety of internal voltages necessary to internal operations. Generating the core voltage will be described preponderantly.

Figure 9:
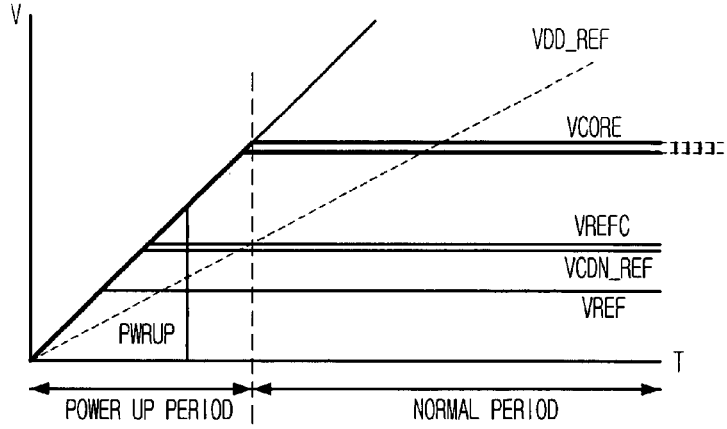
FIG. 9 is a signal timing diagram depicting an operation of the semiconductor memory device described in FIG. 8.

FIG. 9 is a signal timing diagram depicting an operation of the semiconductor memory device described in FIG. 8. The power up signal PWRUP is increased linearly during the power up period. When the supply voltage is higher than a predetermined level, the power up signal PWRUP is disabled as a low level. The first reference signal VREF is output by the first reference signal generator 200 in response to the power up signal PWRUP. The second reference signal VREFC is output by the second reference signal generator 300 in response to the first reference signal VREF. The first and second core voltage generators 400 and 500 generate a predetermined level of core voltage VCORE in response to the second reference signal VREFC respectively. In addition, the second reference signal generator 300 outputs the compensating signal VCDN_REF corresponding to the first and second reference signals VREF and VREFC. The core voltage compensator 600 can compensate a level of the core voltage VCORE stably according to a level of the compensating signal VCDN_REF.

Meanwhile, at the normal mode after the power up period is ended, the second reference signal generator 300 senses when the supply voltage is input below a predetermined level and generates a supply voltage sensing signal ENB. The second reference signal generator 300 outputs the supply voltage sensing signal ENB to the core voltage compensator 600. The core voltage compensator 600 compensates the core voltage VCORE in response to the supply voltage sensing signal ENB, in order to maintain the core voltage VCORE as a constant level.

First of all, the semiconductor memory device generates the core voltage VCORE by using the first core voltage generator 400. And then, comparing the compensating signal VCDN_REF with the core voltage VCORE, the semiconductor memory device compensates the core voltage VCORE by using the core voltage compensator 600. Moreover, the semiconductor memory device senses when the supply voltage decreases and generates the supply voltage sensing signal ENB. Thus, the semiconductor memory device maintains a voltage level of the core voltage.

Figure 10:
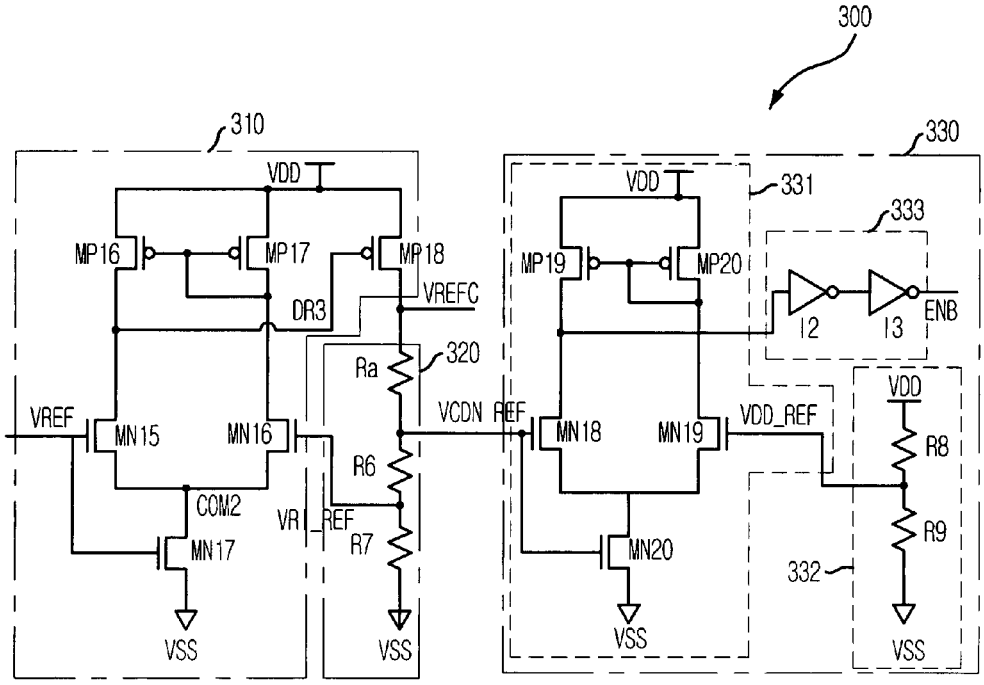
FIG. 10 is a schematic circuit diagram showing a second reference signal generator described in FIG. 8.

FIG. 10 is a schematic circuit diagram illustrating the second reference signal generator 300 described in FIG. 8. The second reference signal generator includes a reference signal generator 310, a compensating signal generator 320, and a voltage sensor 330.

The reference signal generator 310 compares a first comparing signal VRI_REF with the first reference signal VREF and selectively turns on a MOS transistor MP18 according to a comparing result. The voltage level of the second reference signal VREFC determined according to the MOS transistor MP18 is output to the first and second core voltage generators 400 and 500.

The compensating signal generator 320 generates the compensating signal VCDN_REF by decreasing the voltage level of the second reference signal VREFC by a predetermined level. The compensating signal generator 320 includes resistors Ra, R6 and R7 in series for dividing the voltage level of the second reference signal VREFC. The compensating signal VCDN_REF is generated at a node between the first and second resistors Ra and R6, and the first comparing signal VRI_REF is generated at a node between the second and third resistors R6 and R7.

The voltage sensor 330 senses the voltage level of the compensating signal VCDN_REF and generates the supply voltage sensing signal ENB to the core voltage compensator 600. The voltage sensor 330 includes a comparing signal generator 332, a comparator 331 and a sensing signal output unit 333.

The comparing signal generator 332 generates a second comparing signal VDD_REF by dividing the supply voltage. The comparing signal generator 332 includes resistors R8 and R9 in series between the supply voltage and a ground voltage. The second comparing signal VDD_REF is generated at a node between the fourth and fifth resistors R8 and R9.

The comparator 331 compares the compensating signal VCDN_REF with the second comparing signal VDD_REF. The comparator 331 includes MOS transistors. First and second MOS transistors MP19 and MP20 coupled to a supply voltage terminal constitute a current mirror. Third MOS transistor MN18 connected to the first MOS transistor MP19 receives the compensating signal VCDN_REF through a gate. Fourth MOS transistor MN19 connected to the second MOS transistor MP20 receives the second comparing signal VDD_REF through a gate. Fifth MOS transistor MN20 connected between the third and fourth MOS transistors MN18 and MN19 and a ground voltage terminal receives the compensating signal VCDN_REF through a gate. A result of comparing the second comparing signal VDD_REF with the compensating signal VCDN_REF, which is output from a common node of the first and third MOS transistors MP19 and MN18, is provided to the sensing signal output unit 333.

The sensing signal output unit 333 outputs the supply voltage sensing signal ENB according to the comparing result of the comparator 331. The sensing signal output unit 333 includes inverters I2 and I3. The first inverter I2 receives the comparing result, and the second inverter I3 inverts an output of the first inverter I2 to output the supply voltage sensing signal ENB to the core voltage compensator 600.

An operation of the second reference signal generator 300 described in FIG. 10 is described below. Comparing the first reference signal VREF with the first comparing signal VRI_REF, the reference signal generator 310 outputs the second reference signal VREFC having a voltage level corresponding to a comparing result. The compensating signal generator 320 outputs the compensating signal VCDN_REF by decreasing a voltage level of the second reference signal VREFC with a resistance value of the first resistor Ra. The compensating signal generator 320 outputs the first comparing signal VRI_REF by decreasing a voltage level of the second reference signal VREFC with resistance values of the first and second resistors Ra and R6. Comparing the compensating signal VCDN_REF with the second comparing signal VDD_REF, the voltage sensor 330 outputs the supply voltage sensing signal ENB according to a comparing result.

Figure 11:
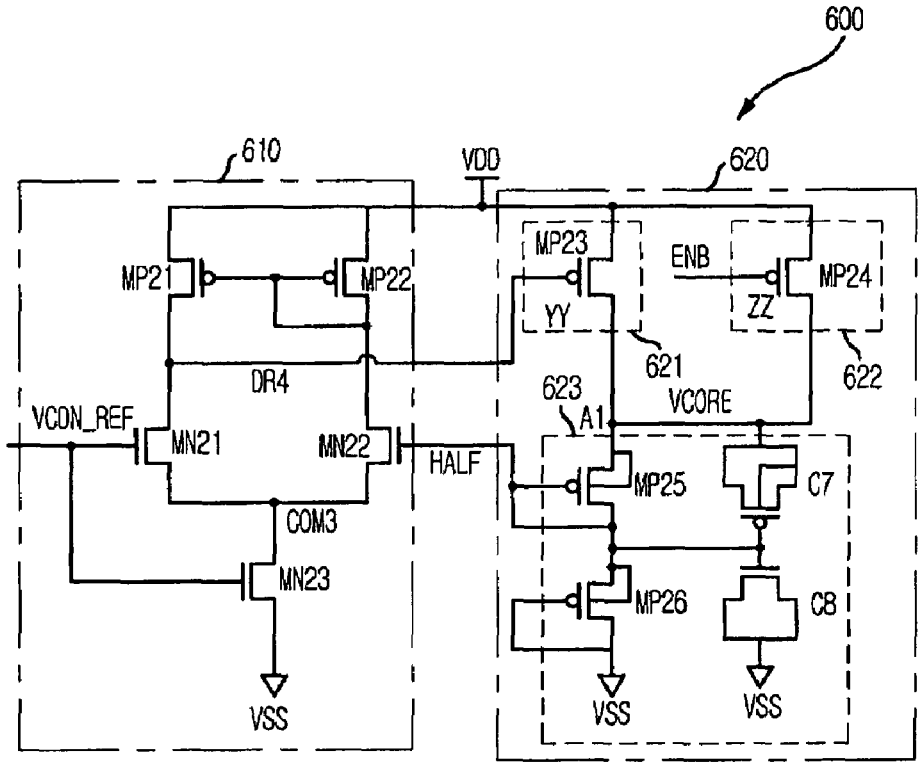
FIG. 11 is a schematic circuit diagram showing a core voltage compensator described in FIG. 8.

FIG. 11 is a schematic circuit diagram illustrating the core voltage compensator 600 described in FIG. 8. The core voltage compensator 600 compensates the core voltage VCORE in response to the compensating signal VCND_REF. The core voltage compensator 600 also compensates the core voltage VCORE in response to the supply voltage sensing signal ENB.

The core voltage compensator 600 includes a core voltage comparator 610, a first voltage compensator 621, a second voltage compensator 622, and a core voltage sensor 623. The core voltage comparator 610 compares the compensating signal VCDN_REF with a core voltage sensing signal HALF. The first voltage compensator 621 provides the supply voltage to a core voltage output node A1 in order to compensate the core voltage up to a predetermined level according to a comparing result of the core voltage comparator 610. The second voltage compensator 622 provides the supply voltage to the core voltage output node A1 in order to compensate the core voltage up to the predetermined level in response to the supply voltage sensing signal ENB. The core voltage sensor 623 generates the core voltage sensing signal HALF to the core voltage comparator 610 by sensing the core voltage VCORE provided to the core voltage output node A1.

The core voltage comparator 610 includes MOS transistors. Sixth and seventh MOS transistors MP21 and MP22 coupled to the supply voltage terminal constitute a current mirror. Eighth MOS transistor MN21 connected to the sixth MOS transistor MP21 receives the compensating signal VCDN_REF through a gate. Ninth MOS transistor MN22 connected to the seventh MOS transistor MP22 receives the core voltage sensing signal HALF through a gate. Tenth MOS transistor MN23 connected between the eighth and ninth MOS transistors MN21 and MN22 and the ground voltage terminal receives the compensating signal VCDN_REF through a gate. A result of comparing the core voltage sensing signal HALF with the compensating signal VCDN_REF is output from a common node of the sixth and eighth MOS transistors MP21 and MN21.

The first voltage compensator 621 includes a eleventh MOS transistor MP23 connected between the supply voltage terminal and the core voltage output node A1, in order to compensate the core voltage VCORE according to the comparing result of the core voltage comparator 610. The second voltage compensator 622 includes a twelfth MOS transistor MP24 connected between the supply voltage terminal and the core voltage output node A1, in order to compensate the core voltage VCORE in response to the supply voltage sensing signal ENB.

The core voltage sensor 623 includes capacitors and diodes. First and second capacitors C7 and C8 are connected in series between the core voltage output node A1 and the ground voltage terminal. A first diode MP25 is connected to the core voltage output node A1 and a second diode MP26 is connected between the first diode MP25 and the ground voltage terminal. A common node of the first and second diodes MP25 and MP26 and a common node of the first and second capacitors C7 and C8 are coupled through which the core voltage sensing signal HALF is output to the core voltage comparator 610.

An operation of the core voltage compensator 600 described in FIG. 10 is described below. The core voltage compensator 600 compares the voltage level of the compensating signal VCDN_REF with the core voltage VCORE. When the voltage level of the compensating signal VCDN_REF is higher than the voltage level of the core voltage sensing signal HALF, the core voltage compensator 600 compensates the core voltage VCORE by providing the supply voltage to the core voltage output node A1. In addition, when the level of the supply voltage becomes lower than a predetermined level, the inactivated supply voltage sensing signal ENB is input in the low logic level. And then, the second voltage compensator 622 is enabled and the core voltage VCOR is compensated.

Figure 12:
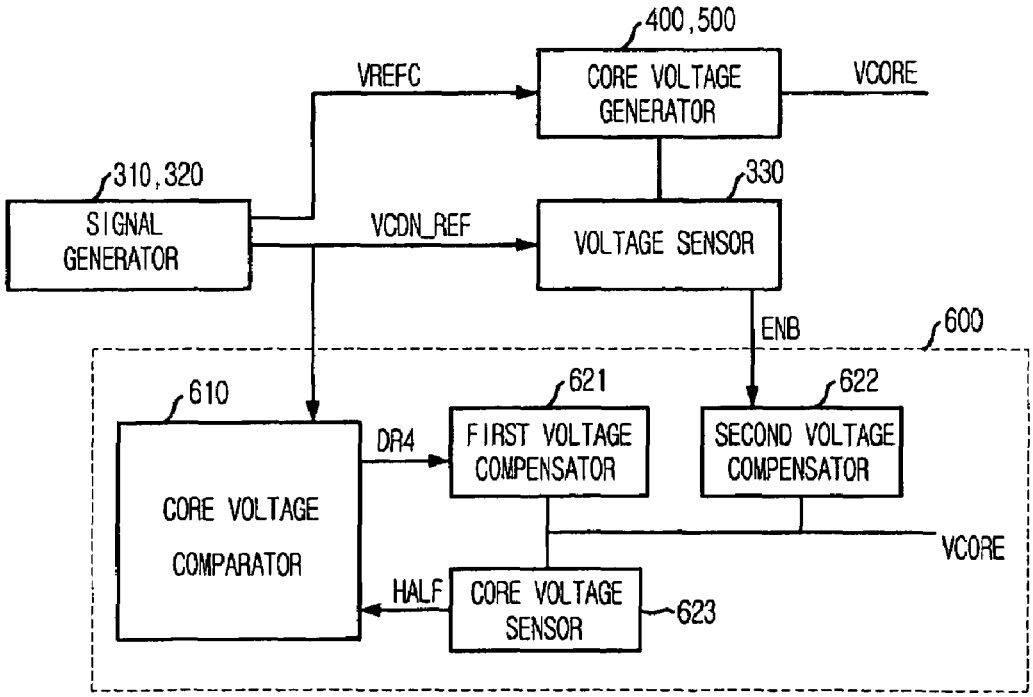
FIG. 12 is a block diagram showing technical features of the present invention.

FIG. 12 is a block diagram illustrating technical features of the present invention. For depicting features of internal circuits described in FIGS. 10 and 11, the block diagram is described with the similar drawing characters as those used in former drawings.

While the present invention has been described with respect to the particular embodiments, it will be apparent to those skilled in the art that various changes and modifications may be made without departing from the spirit and scope of the invention as defined in the following claims.

What is claimed is:

1. A semiconductor memory device, comprising:

a control signal generator for generating a reference signal and a compensating signal which is corresponding to voltage level of the reference signal;

an internal voltage generator for generating an internal voltage in response to the reference signal; and an internal voltage compensator for comparing the compensating signal with the internal voltage, and compensating the internal voltage according to a comparing result.

2. The semiconductor memory device of claim 1, wherein the voltage level of the compensating signal is lower than the voltage level of the reference signal by a predetermined level.

3. The semiconductor memory device of claim 2, wherein the control signal generator includes:

a reference signal generator for generating the reference signal; and a compensating signal generator for generating the compensating signal by decreasing the voltage level of the reference signal.

4. The semiconductor memory device of claim 3, wherein the control signal generator further includes a voltage sensor for generating a supply voltage sensing signal when a supply voltage is lower than a predetermined level.

5. The semiconductor memory device of claim 3, wherein the compensating signal generator includes first, second and third resistors in series for dividing the voltage level of the reference signal and generates the compensating signal at a node between the first and second resistors and a first comparing signal at a node between the second and the third resistors.

6. The semiconductor memory device of claim 5, wherein the reference signal generator includes:

a first comparator for comparing the first comparing signal with an internal signal generated in response to a power up signal; and a reference signal output unit for outputting the reference signal according to a comparing result of the first comparator.

7. The semiconductor memory device of claim 4, wherein the voltage sensor includes:

a comparing signal generator for generating a second comparing signal by dividing the supply voltage;

a second comparator for comparing the compensating signal with the second comparing signal;

a sensing signal output unit for outputting the supply voltage sensing signal according to a comparing result of the second comparator.

8. The semiconductor memory device of claim 7, wherein the comparing signal generator includes fourth and fifth resistors in series between the supply voltage and a ground voltage, and generates the second comparing signal at a node between the fourth and fifth resistors.

9. The semiconductor memory device of claim 7, wherein the second comparator includes:

first and second MOS transistors coupled to a supply voltage terminal for constituting a current mirror;

a third MOS transistor connected to the first MOS transistor for receiving the compensating signal through a gate;

a fourth MOS transistor connected to the second MOS transistor for receiving the second comparing signal through a gate; and a fifth MOS transistor connected between the third and fourth MOS transistors and a ground voltage terminal for receiving the compensating signal through a gate, wherein the comparing result of the second comparing signal with the compensating signal is provided to the sensing signal output unit from a common node of the first and third MOS transistors.

10. The semiconductor memory device of claim 7, wherein the sensing signal output unit includes:

a first inverter for receiving the comparing result; and a second inverter for inverting an output of the first inverter and outputting the supply voltage sensing signal to the internal voltage compensator.

11. The semiconductor memory device of claim 9, wherein the internal voltage compensator includes:

an internal voltage comparator for comparing the compensating signal with an internal voltage sensing signal;

a first voltage compensator for providing the supply voltage to an internal voltage output node in order to compensate the internal voltage to a predetermined level according to a comparing result of the internal voltage comparator;

a second voltage compensator for providing the supply voltage to the internal voltage output node in order to compensate the internal voltage to the predetermined level in response to the supply voltage sensing signal; and an internal voltage sensor for generating the internal voltage sensing signal to the internal voltage comparator by sensing the internal voltage provided to the internal voltage output node.

12. The semiconductor memory device of claim 11, wherein the internal voltage comparator includes:

sixth and seventh MOS transistors coupled to a supply voltage terminal for constituting a current mirror an eighth MOS transistor connected to the sixth MOS transistor for receiving the compensating signal through a gate;

a ninth MOS transistor connected to the seventh MOS transistor for receiving the internal voltage sensing signal through a gate; and a tenth MOS transistor connected between the eighth and ninth MOS transistors and a ground voltage terminal for receiving the compensating signal through a gate, wherein the comparing result of the internal voltage sensing signal with the compensating signal is output from a common node of the sixth and eighth MOS transistors.

13. The semiconductor memory device of claim 12, wherein the first voltage compensator includes an eleventh MOS transistor connected between a supply voltage terminal and the internal voltage output node in order to compensate the internal voltage according to the comparing result of the internal voltage comparator.

14. The semiconductor memory device of claim 13, wherein the second voltage compensator includes a twelfth MOS transistor connected between a supply voltage terminal and the internal voltage output node for receiving the supply voltage sensing signal in order to compensate the internal voltage in response to the supply voltage sensing signal.

15. The semiconductor memory device of claim 11, wherein the internal voltage sensor includes:

first and second capacitors in series connected between the internal voltage output node and a ground voltage terminal;

a first diode connected to the internal voltage output node; and a second diode connected between the first diode and the ground voltage terminal, wherein a common node of the first and second diodes and a common node of the first and second capacitors are coupled through which the internal voltage sensing signal is output to the internal voltage comparator.

16. The semiconductor memory device of claim 1, wherein the internal voltage includes one of a core voltage, a high level of voltage and a lower level of voltage wherein the high level of voltage is higher than the supply voltage by a predetermined level and the low level of voltage is lower than the ground voltage by a predetermined level.

17. The semiconductor memory device of claim 16, wherein the internal voltage generator includes:

a standby mode internal voltage generator for generating the internal voltage in response to the reference signal at a standby mode; and an active mode internal voltage generator for generating the internal voltage in response to the reference signal at an active mode.

18. A semiconductor memory device, comprising:

a control signal generator for generating a reference signal and a compensating signal which is corresponding to the reference signal;

an internal voltage generator for generating an internal voltage in response to the reference signal;

an internal voltage sensor for sensing the internal voltage and generating an internal voltage sensing signal;

a voltage comparator for comparing the compensating signal with the internal voltage sensing signal; and a first voltage compensator for compensating the internal voltage according to a comparing result of the voltage comparator.

19. The semiconductor memory device of claim 18, further comprising:

a voltage sensor for generating a supply voltage sensing signal in case that a supply voltage is lower than a predetermined level; and a second voltage compensator for compensating the internal voltage in response to the supply voltage sensing signal.

20. The semiconductor memory device of claim 18, wherein control signal generator includes:

a reference signal generator for generating the reference signal; and a compensating signal generator for generating the compensating signal by decreasing the voltage level of the reference signal.

21. The semiconductor memory device of claim 20, wherein the compensating signal generator includes resistors in series for dividing the voltage level of the reference signal and generates the compensating signal at a node between first and second resistors.

22. The semiconductor memory device of claim 19, wherein the voltage sensor includes:

a comparing signal generator for generating a comparing signal by dividing the supply voltage;

a comparator for comparing the compensating signal with the comparing signal;

a sensing signal output unit for outputting the supply voltage sensing signal according to a comparing result of the comparator.

23. The semiconductor memory device of claim 22, wherein the comparing signal generator includes resistors in series between the supply voltage and a ground voltage, and generates the comparing signal at a node between fourth and fifth resistors.

24. The semiconductor memory device of claim 22, wherein the comparator includes:

first and second MOS transistors coupled to a supply voltage terminal for constituting a current mirror;

a third MOS transistor connected to the first MOS transistor for receiving the compensating signal through a gate;

a fourth MOS transistor connected to the second MOS transistor for receiving the comparing signal through a gate; and a fifth MOS transistor connected between the third and fourth MOS transistors and a ground voltage terminal for receiving the compensating signal through a gate, wherein the comparing result of the comparing signal with the compensating signal is output to the sensing signal output unit from a common node of the first and third MOS transistors.

25. The semiconductor memory device of claim 22, wherein the sensing signal output unit includes:

a first inverter for receiving the comparing result; and a second inverter for inverting an output of the first inverter and outputting the supply voltage sensing signal to the second voltage compensator.

26. The semiconductor memory device of claim 24, wherein the voltage comparator includes:

sixth and seventh MOS transistors coupled to a supply voltage terminal for constituting a current mirror;

an eighth MOS transistor connected to the sixth MOS transistor for receiving the compensating signal through a gate;

a ninth MOS transistor connected to the seventh MOS transistor for receiving the internal voltage sensing signal through a gate; and a tenth MOS transistor connected between the eighth and ninth MOS transistors and a ground voltage terminal for receiving the compensating signal through a gate, wherein the comparing result of the internal voltage sensing signal and the compensating signal is output from a common node of the sixth and eighth MOS transistors.

27. The semiconductor memory device of claim 26, wherein the first voltage compensator includes an eleventh MOS transistor connected between a supply voltage terminal and an internal voltage output node in order to compensate the internal voltage according to the comparing result of the voltage comparator.

28. The semiconductor memory device of claim 27, wherein the second voltage compensator includes a twelfth MOS transistor connected between a supply voltage terminal and an internal voltage output node for receiving the supply voltage sensing signal in order to compensate the internal voltage in response to the supply voltage sensing signal.

29. The semiconductor memory device of claim 28, wherein the internal voltage sensor includes:

first and second capacitors in series connected between an internal voltage output node and a ground voltage terminal;

a first diode connected to the internal voltage output node; and a second diode connected between the first diode and the ground voltage terminal, wherein a common node of the first and second diodes and a common node of the first and second capacitors are coupled through which the internal voltage sensing signal is output to the voltage comparator.

30. The semiconductor memory device of claim 28, wherein the internal voltage includes one of a core voltage, a high level of voltage and a lower level of voltage wherein the high level of voltage is higher than the supply voltage by a predetermined level and the low level of voltage is lower than the ground voltage by a predetermined level.

31. The semiconductor memory device of claim 30, wherein the internal voltage generator includes:

a standby mode internal voltage generator for generating the internal voltage in response to the reference signal at a standby mode; and an active mode internal voltage generator for generating the internal voltage in response to the reference signal at an active mode.

* * * * *